US008180205B2

(12) United States Patent
Yao

(10) Patent No.: US 8,180,205 B2
(45) Date of Patent: May 15, 2012

(54) ELECTROTHERMAL OIL RADIATOR

(76) Inventor: Guoning Yao, Ningbo Cixi (CN)

( * ) Notice: Subject to any disclaimer, the term of this patent is extended or adjusted under 35 U.S.C. 154(b) by 491 days.

(21) Appl. No.: 12/522,276

(22) PCT Filed: Jan. 12, 2007

(86) PCT No.: PCT/CN2007/000129

§ 371 (c)(1),
(2), (4) Date: Jul. 7, 2009

(87) PCT Pub. No.: WO2008/086652

PCT Pub. Date: Jul. 24, 2008

(65) Prior Publication Data

US 2010/0027980 A1 Feb. 4, 2010

(51) Int. Cl.
*F24C 1/14* (2006.01)
*F24D 13/04* (2006.01)

(52) U.S. Cl. ..... 392/377; 392/378; 165/130; 165/171

(58) Field of Classification Search ..... 392/375–379
See application file for complete search history.

(56) References Cited

U.S. PATENT DOCUMENTS 3,512,238 A * 5/1970 Raymond et al. ..... 29/890.042
5,341,455 A * 8/1994 de' Longhi ..... 392/378
5,685,365 A * 11/1997 De'Longhi ..... 165/135
6,263,157 B1 * 7/2001 De' Longhi ..... 392/378
6,289,175 B1 * 9/2001 De' Longhi ..... 392/357

FOREIGN PATENT DOCUMENTS

| | | | |
|---|---|---|---|
| CN | 2225623 | Y | 4/1996 |
| CN | 2238393 | Y | 10/1996 |
| CN | 2253435 | Y | 4/1997 |
| CN | 2536943 | Y | 2/2003 |
| CN | 2783184 | Y | 5/2006 |
| DE | 2440184 | | 8/1974 |
| DE | 2360229 | | 6/1975 |
| EP | 0949460 | A2 | 10/1999 |
| GB | 2275005 | A | 8/1994 |

* cited by examiner

*Primary Examiner* — Thor Campbell
(74) *Attorney, Agent, or Firm* — Wood, Herron & Evans, LLP

(57) ABSTRACT

An electrothermal oil radiator includes a radiating body (1), an electric-control box (2) mounted on the radiating body (1) and a heating body (3) located inside the radiating body (1). The radiating body (1) includes a plurality of radiating fins (11) linked in turn. Each radiating fin (11) is hollow and sheet-like and has at least two oil leading grooves (12) inside thereof. Hollow connecting sleeves (13) extending horizontally are formed or mounted on upper and lower ends of each radiating fin (11). An oil leading hole in communication with the oil leading grooves (12) is formed in each connecting sleeve (13). The sleeves (13) on each radiating fin (11) are connected together to form a sealed oil cavity in which heat conducting oil is filled. A reinforcing radiating fin (4) is mounted between two adjacent radiating fins (11).

9 Claims, 6 Drawing Sheets

ELECTROTHERMAL OIL RADIATOR

BACKGROUND OF THE INVENTION

1. Technical Field of the Invention

The present invention relates to a heating device, more particularly to an electrothermal radiator filled with oil.

2. Description of the Related Art

In the prior art design, radiating power of an electrothermal oil radiator is proportional to the size of radiating fins thereof, namely, due to more radiating power, with consequent larger radiating fin's size, consequently overall dimension of the radiator has goes bigger. A Chinese patent ZL02225717.9, issued on Feb. 19, 2003 with the published No: CN2536943, disclosed an electric heater filled with oil which comprises a heating tube, a connecting sleeve, a plurality of radiating fins filled with oil, a control box, wherein said connecting sleeve and the adjacent radiating fin thereof are coupled, the heating tube is inserted into the connecting sleeves and the radiating fins, on the other hand, the heating tube is immersed in heat conducting oil filled in the radiating fin, the radiating fin connected to the control box is not filled with oil and placed on external of the connecting sleeve. Said patent uses this certain structure, the radiating fin connected to the control box is not filled with oil and placed on external of the connecting sleeve, which makes this reradiating fin indirectly conducting heat of other radiating fins to the control box instead of directly conducting own heat, therefore, without effecting overall function and shape of the electric heater, it dramatically decreases the internal temperature of the control box, and then makes the temperature of the control units inside the control box, such as handles and buttons, lower, so as to avoid damage caused by overheat, and make the service life of the electric heater longer. Although, the above mentioned Chinese patent has a certain improvement, it still has disadvantage of a conventional electric heater, i.e. radiating power goes greater, radiating fin's size goes larger.

SUMMARY OF THE INVENTION

The present invention is directed to solve the problems exiting in the prior art, accordingly, provides an electrothermal oil radiator with a high radiating power, but with less dimension and aesthetic appearance.

According to the present invention, there is provided an electrothermal oil radiator, comprises a radiating body, an electric-control box mounted on the radiating body and a heating body placed inside of said radiating body, the radiating body includes a plurality of radiating fins connected in turn, each of the radiating fin is hollow and sheet-like, there are at least two oil leading grooves formed inside of each radiating fin, hollow connecting sleeves extending horizontally are formed or mounted on upper and lower ends of each radiating fin, an oil leading hole in communication with the oil leading grooves is formed in each connecting sleeve, a sealed oil cavity in which heat conducting oil filled is formed by the connecting sleeves connected together. A reinforcing radiating fin is mounted between adjacent radiating fins.

Said electrothermal oil radiator, according to the present invention, also has following features:

The reinforcing radiating fin has a single sheet structure and comprises a radiating plate and a radiating wall connected with said radiating plate.

The reinforcing radiating fin is clamped on connection portion of the connecting sleeves between the adjacent radiating fins.

A protruding ring, formed on one end of a connecting sleeve, passes through said reinforcing radiating fin and is inserted into another end of said adjacent connecting sleeve.

A plurality of radiating apertures is formed on a top of the radiating wall.

The radiating apertures are strip-shaped.

The reinforcing radiating fin has same shape with the radiating fin.

A folded edge is formed on the radiating wall.

A width of the radiating wall is 60%-80% of a distance between the adjacent radiating fins.

At least one recess is formed on the radiating plate.

An electrothermal oil radiator according to the present invention has following advantages compared with the radiators of the prior art: firstly, reinforcing radiating fins without filled with oil are placed between the each two adjacent radiating fins filled with oil, the radiating effect of the electrothermal oil radiator is improved, so as to dramatically increase the radiating power thereof without obviously increasing the dimension thereof, a problem of the prior art in which an electrothermal oil radiator with a high radiating power must corresponding with large radiating fins is solved; secondly, a heating tube is mounted in a connecting sleeve, which causes there is the highest temperature obtained in the connecting sleeve, therefore, it can maximally radiate heat and improve radiating effect by mounting the reinforcing radiating fins on connection portions of the connecting sleeves; thirdly, the overall figure of the reinforcing radiating fin is as same as the figure of the radiating fin, on the other hand, a radiating wall of the reinforcing radiating fin is capable of filling a gap of the radiating fin, therefore, a product of the electrothermal oil radiator according to the present invention bears an aesthetic feeling.

DETAILED DESCRIPTION OF EMBODIMENTS OF THE INVENTION

Figure 11:
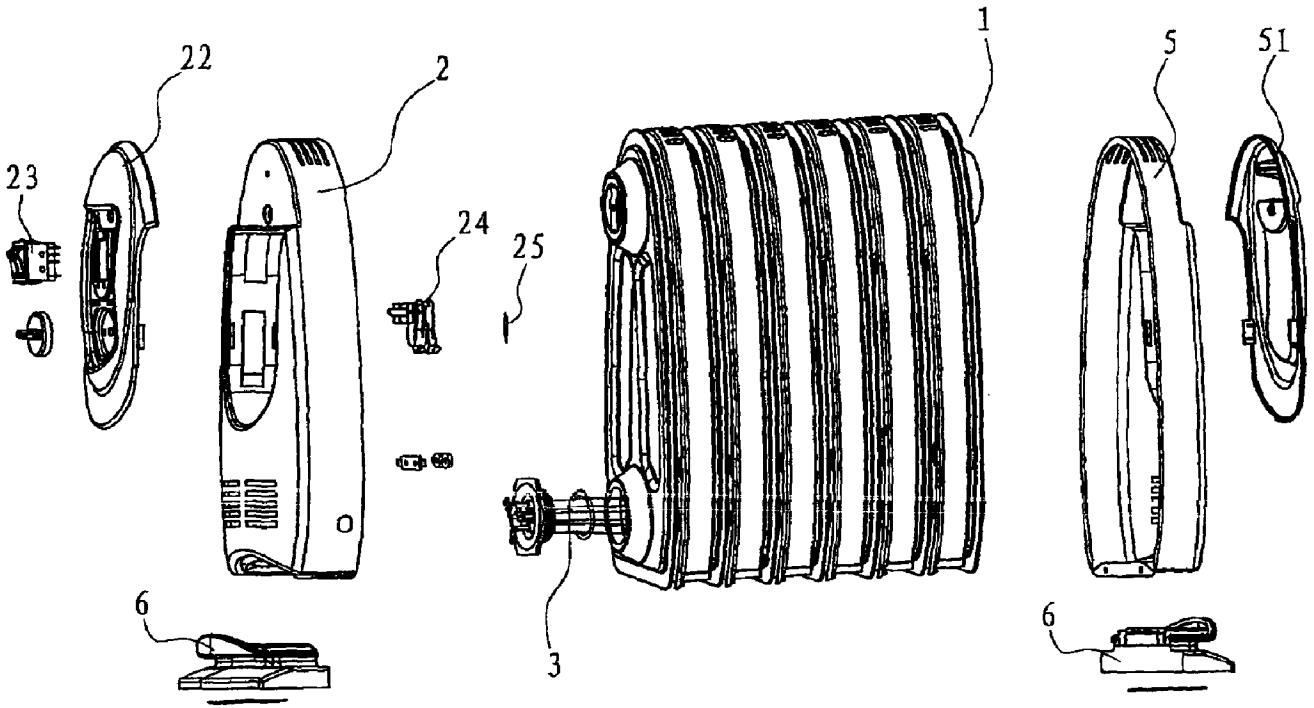
FIG. 11 is an exploded perspective view of FIG. 1.

As shown in FIG. 1-6, the present invention provides a preferred embodiment of an electrothermal oil radiator which comprises a radiating body 1, an electric-control box 2 mounted on said radiating body 1 and a heating body 3 located inside of said radiating body 1, said radiating body 1 comprises a plurality of radiating fins 11 connected in turn, each of radiating fin 11 is hollow and sheet-like and at least two oil leading grooves 12 are formed inside each of the radiating fin 11, hollow connecting sleeves 13 extending horizontally are formed on upper and lower ends of each radiating fin 11, an oil leading hole, in communication with the oil leading grooves 12, is formed in each connecting sleeve 13, a sealed oil cavity in which heat conducting oil filled is formed by the connecting sleeves 13 connected together and the oil leading grooves 12. As shown in FIG. 11, the heating body 3 is mounted in the connecting sleeves. A temperature controller 24 and an overheating protector 25 are installed inside the electric-control box 2 which front end is provided with a front panel 22, a switch 23 and a turn button are mounted on the front panel 22. The temperature controller 24 can control the heating temperature, and the overheating protector 25 can prevent the radiator from overheating. There is a back cover 5 adapted to be mounted on rear end of the radiator, and a handle 51 is disposed on the back cover 5 in order to conveniently move the radiator. A base 6 is mounted on bottom of the radiator, so as to easily place the radiator.

The connecting sleeves 13 in accordance with the present invention are also adapted to be mounted on the radiating fin 11. Each of the radiating fin 11 is manufactured by two sheets and has uniform figure and dimension. A reinforcing radiating fin 4 is mounted between every tow adjacent radiating fins, which distinguishes with the prior art design. The reinforcing radiating fin 4 may further increase the radiating effect, but without increasing the volume of the electrothermal oil radiator. Therefore, the radiator of the present invention has less dimension than other radiator of the prior art design having same power, and easily to be arranged in house.

Figure 7:
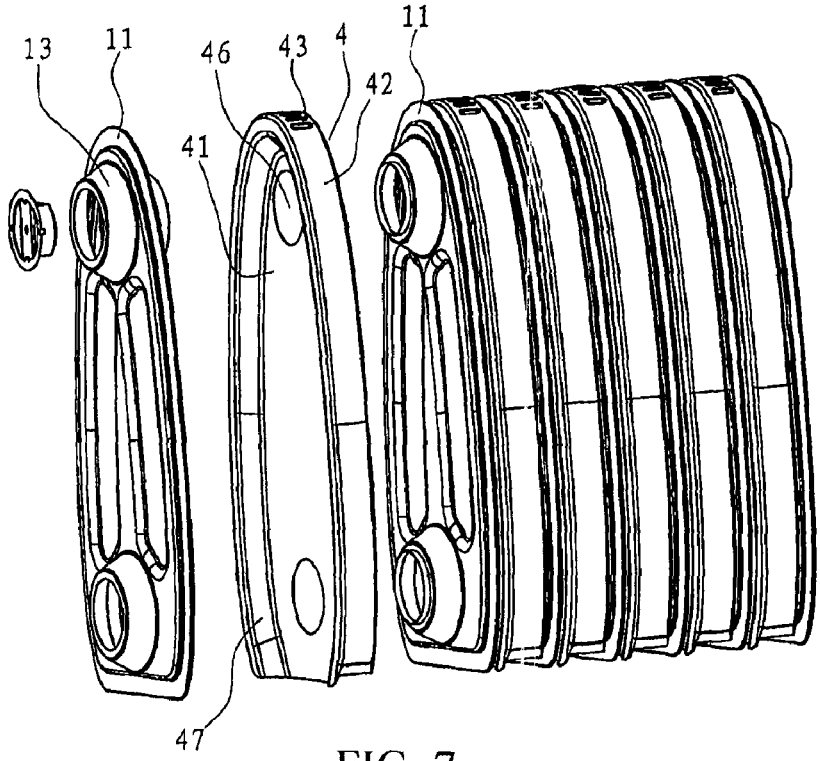
FIG. 7 is an exploded perspective view of FIG. 4.
Figure 8:
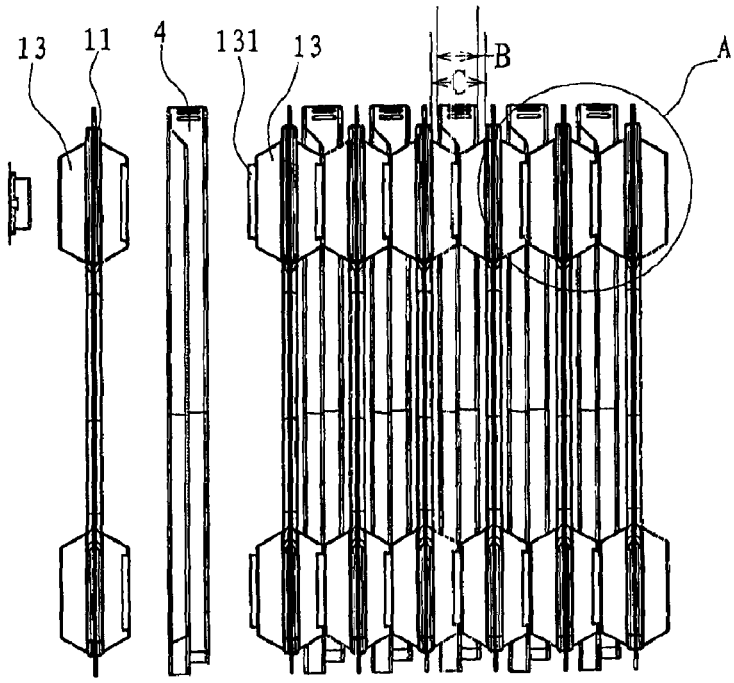
FIG. 8 is an exploded sectional view of FIG. 4.
Figure 9:
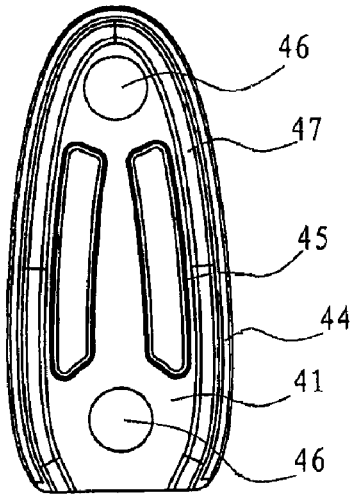
FIG. 9 is a left view of a reinforcing radiating fin described in FIG. 4.
Figure 10:
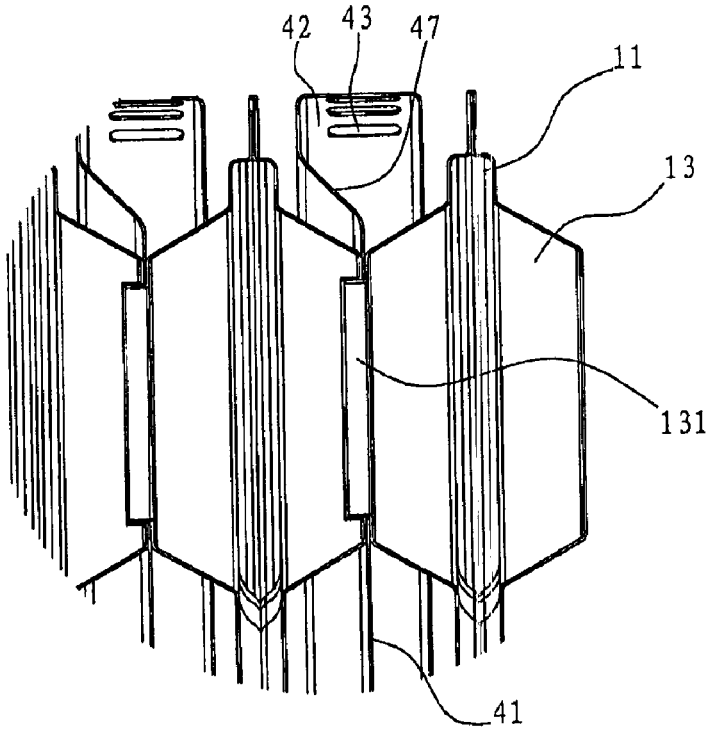
FIG. 10 is an enlarged view of section A in FIG. 8.

As shown in FIG. 7-9, the reinforcing radiating fin 4 is a single sheet structure, and comprises a radiating plate 41 and a radiating wall 42 connected with the radiating plate 41. The radiating plate 41 is not filled with oil and is connected to one side edge of the radiating wall 42 by a skew plate 47. Particularly as shown in FIG. 10, this structure not only ensures the position of the radiating plate 41 in middle of the width of the radiating wall 42, but also allows the reinforcing radiating fin 4 to be manufactured by punching. Meanwhile, this structure is advantageous for raise of heating air.

As shown in FIG. 8 and FIG. 10, the reinforcing radiating fin 4 is clamped in a connection portion of said connecting sleeves 13 between the adjacent radiating fins 11. Because the heating body 3 is mounted inside of the connecting sleeves 13, the connecting sleeves 13 obtain the highest temperature, consequently the arrangement of fixing the reinforcing radiating fin 4 on the connecting sleeve 13 is not only advantageous for installation, but also reaches a best radiating effect.

As shown in FIGS. 7-10, a protruding ring 131 formed on one end of a connecting sleeve 13 is inserted into another end of the adjacent connecting sleeve 13 through a hole 46 of the reinforcing radiating fin 4. Therefore, said reinforcing radiating fin 4 is clamped between adjacent connecting sleeves 13, easy to install. Each of the connecting sleeve 13 are hermetically connected together, in installing practice, the protruding ring 131 is inserted into another end of the adjacent connecting sleeve 13, then welding them together, therefore, the reinforcing radiating fin 4 is tightly fixed between end walls of the adjacent connecting sleeves 13.

Figure 1:
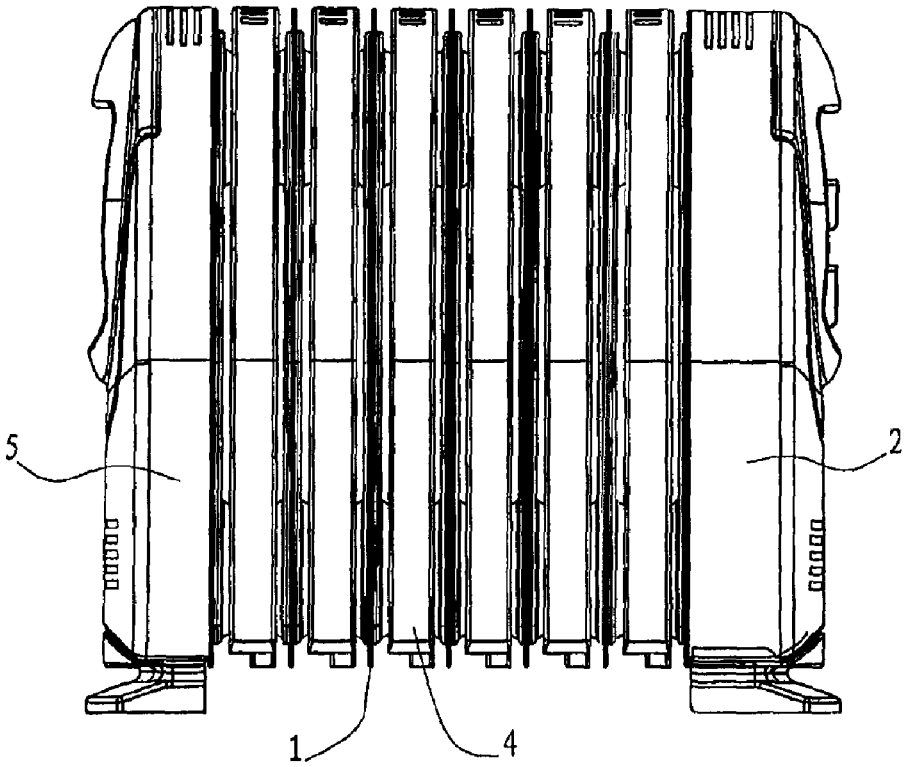
FIG. 1 is a front view of an electrothermal oil radiator according to the present invention.
Figure 2:
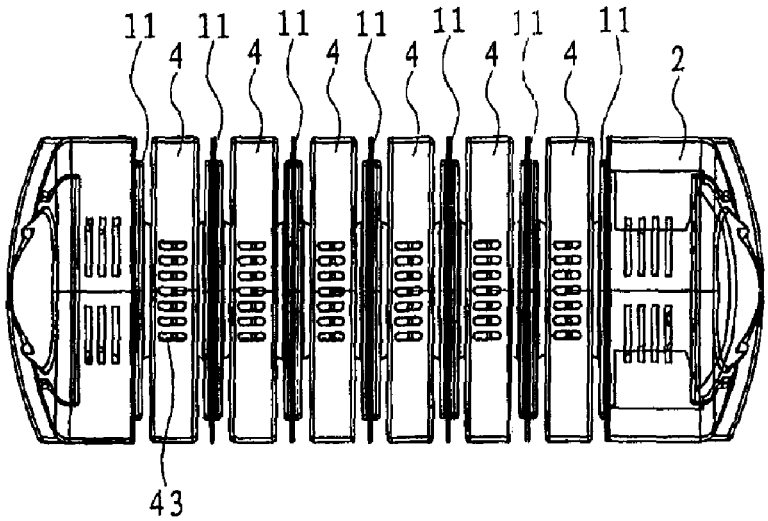
FIG. 2 is a top view of FIG. 1.
Figure 3:
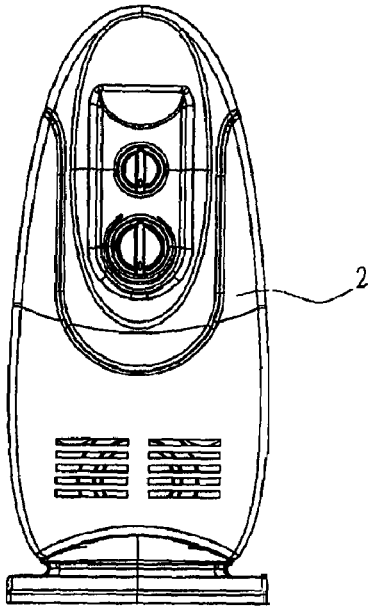
FIG. 3 is a right view of FIG. 1.
Figure 4:
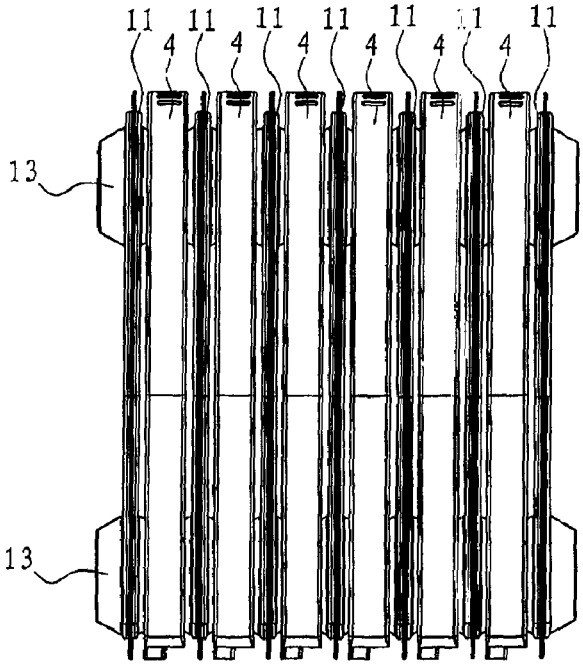
FIG. 4 is a front view of a radiating body described in FIG. 1.
Figure 6:
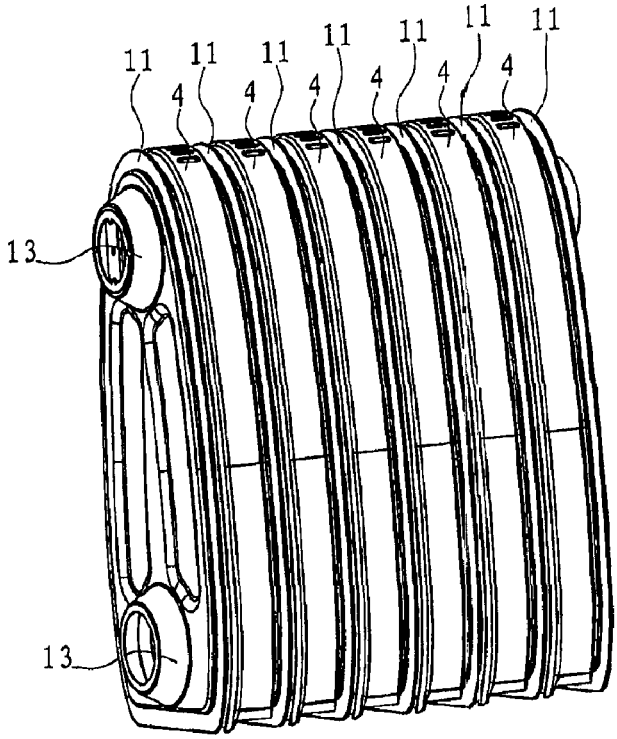
FIG. 6 is a perspective view of FIG. 4.

As shown in FIGS. 2 and 6, a plurality of strip-shaped radiating apertures 43 are formed on top of the radiating wall 42, this arrangement of the radiating apertures 43 is advantageous to raise of heat air, so that ventilation effect is improved, the radiating effect of the present invention is increased.

Figure 5:
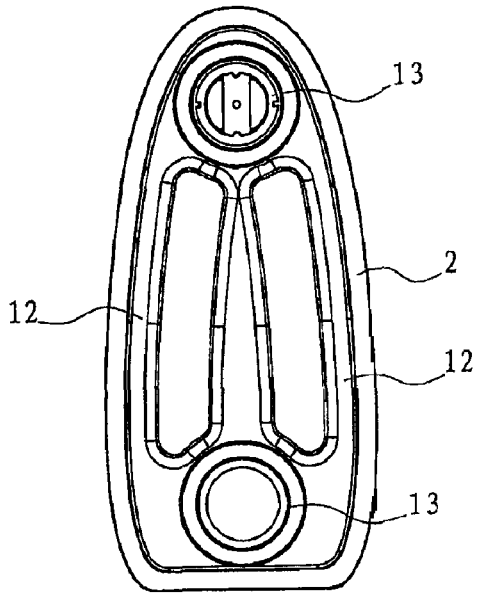
FIG. 5 is a left view of FIG. 4.

As shown in FIGS. 5, 8 and 9, the reinforcing radiating fins have same shapes with the radiating fins 11. A width B of the radiating wall is 60%-80% of distance C between the adjacent radiating fins 11, it is 74% in this example. A folded edge 44 is formed on the radiating wall 42. Therefore, the radiating ability of the present invention is excellent, and the overall figure of the present invention is aesthetic feeling as well. A folded edge 44 which prevents a user from cutting by edge is formed on the radiating wall 42.

As shown in FIG. 9, at least one recess 45 is formed on the radiating plate 41 by punching, therefore, in order to improve the overall strength of the reinforcing radiating fin 4.

What is claimed is:

1. An electrothermal oil radiator, comprising:

a radiating body including a plurality of radiating fins connected in turn, each of the radiating fin is hollow and sheet-like at least two oil leading grooves formed inside each of the radiating fin hollow connecting sleeves extending horizontally formed or mounted on upper and lower ends of each radiating fin an oil leading hole in communication with the oil leading grooves formed in each connecting sleeve a sealed oil cavity wherein heat conducting oil filled is formed by the connecting sleeves connected together;

an electric-control box mounted on the radiating body;

a heating body located inside the radiating body;

wherein a reinforcing radiating fin mounted between two adjacent radiating fins, and said reinforcing radiating fin has a single sheet structure and comprising:

a radiating plate;

a radiating wall connected with said radiating plate.

2. The radiator of the claim 1, wherein said reinforcing radiating fin mounted on a connection portion of said connecting sleeves between said two adjacent radiating fins.

3. The radiator of the claim 2, wherein a protruding ring is formed on one end of a connecting sleeve of said radiating fins and inserted into another end of the adjacent connecting sleeve of said radiating fins through a reinforcing radiating fin.

4. The radiator of the claim 1, wherein a plurality of radiating apertures are formed on top of said radiating wall.

5. The radiator of the claim 4, wherein said radiating apertures is strip-shaped.

6. The radiator of the claim 1, wherein said reinforcing radiating fin has same shape with said radiating fin.

7. The radiator of the claim , wherein a folded edge is formed on said radiating wall.

8. The radiator of the claim 1, wherein a width B of said radiating wall is 60%-80% of a distance C between said adjacent radiating fins.

9. The radiator of the claim 1, wherein at least one recess is formed on said radiating plate.

* * * * *

UNITED STATES PATENT AND TRADEMARK OFFICE

CERTIFICATE OF CORRECTION

PATENT NO. : 8,180,205 B2
APPLICATION NO. : 12/522276
DATED : May 15, 2012
INVENTOR(S) : Guoning Yao It is certified that error appears in the above-identified patent and that said Letters Patent is hereby corrected as shown below:

Column 1, line 14, "has goes bigger" should be -- gets bigger --

Column 1, line 29-30, "effecting" should be -- affecting --

Column 2, line 23-24, "causes there is the" should be -- causes the --

Column 3, line 19, "every tow adjacent" should be -- every two adjacent --

Claim 1, Column 4, lines 21-22, "each of the radiating fin is hollow and sheet-like at least two oil leading grooves formed inside each of the radiating fin hollow" should be -- each of the radiating fins is hollow and sheet-like, at least two oil leading grooves formed inside each of the radiating fins, hollow --

Claim 1, Column 4, line 23, "fin an oil" should be -- fin, an oil --

Claim 1, Column 4, line 25, "connecting sleeve a sealed" should be -- connecting sleeve, a sealed --

Claim 1, Column 4, line 30, "fin mounted between" should be -- fin being mounted between --

Claim 2, Column 4, line 37, "radiating fin mounted" should be -- radiating fin being mounted --

Claim 5, Column 4, lines approximately 46-47, "apertures is" should be -- apertures are --

Claim 7, Column 4, line 50, "The radiator of claim , wherein" should be -- The radiator of claim 1, wherein --

Signed and Sealed this
Second Day of October, 2012

David J. Kappos

David J. Kappos
*Director of the United States Patent and Trademark Office*